United States Patent [19]

Lemelson

[11] Patent Number: 4,856,509

[45] Date of Patent: Aug. 15, 1989

[54] FACE MASK AND METHOD

[76] Inventor: Jerome H. Lemelson, 85 Rector St., Metuchen, N.J. 08840

[21] Appl. No.: 752,829

[22] Filed: Jul. 8, 1985

[51] Int. Cl.[4] ..... A62B 7/10

[52] U.S. Cl. ..... 128/206.19; 128/206.16

[58] Field of Search ..... 128/139, 205.77–265.29, 128/206.19, 206.12, 206.11, 206.13, 206.18, 253.29; 55/279

[56] References Cited

U.S. PATENT DOCUMENTS

| | | | |
|---|---|---|---|
| 443,191 | 12/1890 | Illing | 55/279 |
| 715,052 | 12/1902 | Goodwin | 128/206.13 |
| 838,434 | 12/1906 | Morgan | 55/279 |
| 1,839,168 | 12/1931 | Stampe | 128/205.27 |
| 3,101,709 | 8/1963 | Gruenewaelder | 128/206.12 |
| 3,116,969 | 1/1964 | Coleman | 128/205.29 |
| 3,457,917 | 7/1965 | Mercurio | 55/279 |
| 3,971,369 | 7/1976 | Aspelin et al. | 128/206.19 |
| 4,467,799 | 8/1984 | Steinberg | 128/206.14 |
| 4,682,992 | 7/1987 | Fuchs | 55/279 |

FOREIGN PATENT DOCUMENTS

| | | | |
|---|---|---|---|
| 768557 | 2/1957 | United Kingdom | 128/206.12 |

*Primary Examiner*—Max Hindenburg
*Assistant Examiner*—K. M. Reichle
*Attorney, Agent, or Firm*—Neil F. Markva

[57] ABSTRACT

This invention relates to improvements in face masks, particularly for use in preventing the spread of disease such as colds, influenza and the like wherein a select portion or portions of such mask contain a disease or viral destroying chemical or biological agent, such as an acid or other material impregnating or forming part of a portion of the mask, such as that portion which extends across the nasal and mouth portions of the face of a wearer. In one form, the chemical or biological agent is in the form of a solid, such as a coating or a multitude of particles or crystals disposed against a porous portion of the mask or an insert which is attachable to and replaceable with respect to a mask frame or holding unit. In another form, such chemical is in the form of a liquid. In a third form, such chemical is disposed within a multitude of micro capsules which are ruptured or otherwise activated when the mask is used and which dispense their contents during such use and distribute the same throughout a select portion of the mask. In a particular form, the mask is formed of a unitary sheet of porous paper, cellular plastic or non-woven fiber with a portion of the outer layer thereof impregnated with a viral killing chemical, such as citric acid, to prevent passage of viral agents either from a person using the mask or from the atmosphere.

25 Claims, 1 Drawing Sheet

FACE MASK AND METHOD

BACKGROUND OF THE INVENTION

1. Field Of The Invention

This invention concerns a face mask and a method for destroying bacteria and viruses which may travel in either direction with air inhaled or exhaled through the mask. In particular, the invention concerns a face mask which is porous in structure and contains, either disposed within an outer or central layer of the mask or a porous sheet material attached to the outer surface of the mask, a chemical, such as citric acid, which is capable of destroying biological agents, such as microbes and viruses, which pass into the mask and flow either therethrough or through a porous attachment to the mask.

2. Description Of The Prior Art

The prior art consists of a variety of face masks used by medical personnel and sometimes applied to patients, to prevent the spread of disease. Such masks have been generally made of porous paper, such as filter-type paper or other non-woven breathable material and are exemplified by such U.S. Pat. Nos. as 2,012,505; 3,220,409; 4,038,979 and 4,148,958. The prior art merely attempts to trap microscopic bacteria and the like in and against the walls of the cells of the porous material of which the mask is made. However, with prolonged use, such masks do permit the passage of certain microscopic disease causing material, such as viruses and the like carried on microscopic particles of dust and in aerosoled particles of liquid such as created when a person sneezes or coughs.

SUMMARY OF THE INVENTION

The principle object of the present invention is to provide new and improved structures in face masks and methods for preventing the spread of disease such as those carried on particles of dust or in aerosoled particles of body fluids. In particular, the invention employs one or more chemicals applied in the form of a liquid, vapor or solid particles or a combination of same, impregnating or sprayed against the outer surface of the mask or coating a film or sheet of porous material which is secured to the outer face of the mask. In a preferred form, such a disease germ killing chemical is applied to a central portion of the mask between the outer and inner surfaces thereof to prevent general contact of the disease germ killing agent with either the skin of the face or the hands or is encapsulated prior to use of the mask.

If the disease germ killing chemical or agent is applied as a liquid, it is sprayed, roller coated or otherwise applied to the outer surface of the mask, which mask may be packaged in a sealed container to prevent evaporation of the liquid from the mask. Alternatively, a coating of such chemical may be applied to the outer surface of the mask, over which a coating of a film of non-porous plastic may be applied and adhesively bonded to the mask in a manner to permit such film to be peeled off the mask when it is ready to be used or retained if the film is porous.

In yet another form, liquid disease germ killing chemicals may be disposed in a multitude of microminiature rupturable capsules, such as plastic micro balloons or the like, which capsules may be applied to the outer surface and/or an inner layer of the porous sheet material of which the mask is fabricated. Such rupturable capsules may be ruptured by hand or otherwise caused to release their chemical contents into the surrounding cells of the mask to permit such chemical to receive and destroy bacteria and viral agents flowing into the cells or pores of the mask.

Accordingly it is a primary object of this invention to provide a new and improved medical mask which is capable of destroying bacteria and/or viral agents passing through the mask.

Another object is to provide a low cost face mask for use in medical applications and the like, which contains a chemical coating or impregnation within a portion of the mask through which portion or portions air flows to and from the nostrils and mouth of the user of the mask, wherein such chemical containing portion or portions serve to destroy disease agents, such as bacteria and viruses flowing through the mask when a person wearing the mask breathes.

Another object is to provide a face mask which is particularly useful in medical applications and in preventing the spread of disease agents by a chemical which impregnates a portion of the mask but is prevented from flowing to and irritating the skin of the wearer of the mask.

Another object is to provide a medical mask useful in preventing disease germs and viruses from passing through the mask in either direction when a person wearing the mask breathes and incorporating a disease germ killing agent in the form of a mild acid, such as citric acid, which is normally prevented from flowing out of the mask and against the skin of a person handling or using the mask.

Another object is to provide an improved face mask made of a porous sheet-like material and containing a disease germ killing agent encapsulated within microminiature cells of the mask or disposed within cells of the mask wherein such capsules may be manipulated or ruptured to permit their contents to be released to the cells of the mask so as to effect the destruction of germs and viruses passing through the mask when a person wearing the mask breathes.

Another object is to provide a medical mask for use in preventing the spread of disease, which mask is made of a lightweight porous sheet material and is adapted to cover the end of the nose and mouth of a person wearing the mask, wherein a central portion of the mask aligned with the mouth and end of the nose contains a disease killing agent coating or impregnating same.

Another object is to provide an improved structure in a disposable face mask which not only serves to filter bacteria from the air passed therethrough but also serves to kill such bacteria within the wall of the mask.

Another object is to provide an improved disposable face mask capable of destroying viruses such as retrovirus, carried on dust and droplets of water vapor, saliva and the like passed through the wall of the mask during breathing and coughing.

Another object is to provide an improved face mask for use in preventing the spread of disease by or to the user thereof wherein a disease germ killing agent is supported within a layer of material between the outer layers of the wall of the mask and is thereby prevented from contacting the skin of the face of the wearer and surfaces, such as the skin of the hands, exterior of the mask.

Another object is to provide a face mask which is particularly useful in preventing the spread of cold viruses and the like.

Another object is to provide a face mask containing a disease germ killing agent in the form of a chemical or biological material contained within open cells or interstices of the mask and operable to destroy bacteria and viruses carried on the breath and on particles such as body fluid, vapor, and dust particles passed into and entrapped by the mask.

Another object is provide a face mask with a filter element containing a disease germ destroying agent permeating the interstices or open cells of the filter which agent forms a vapor within the mask cells when the mask is in use which vapor is effective in destroying or deactivating disease germs and the like which are airborn in the air passing through the mask.

Another object is to provide a face mask with a filter element containing a disease germ destroying or deactivating agent in the form of solid particles, such as crystals or otherwise constructed fine particles entrapped in at least a portion of the cells or secured to fibers of the filter and operable to receive dust and vapor particles containing virus and germs and to kill or deactivate same.

Another object is to provide a face mask with a filter element supporting a disease germ destroying or deactivating agent which volatizes when the mask is used and fills the interstices or open cells of the mask filter in a manner to kill or deactivate bacteria and viruses which are airborn and pass into the mask.

Another object is to provide a face mask with a chemical disease germ killing agent impregnating the mask in a solid form or encapsulant and is released therefrom as a result of a reaction between the breath of a person wearing the mask and breathing through the mask.

Another object is to provide a face mask with a liquid disease germ killing or deactivating agent encapsulated within micro balloons secured within or across at least a portion of the mask filter element which liquid is releasable from such micro balloons when they are ruptured by pressure applied to the mask by hand.

Another object is to provide a porous face mask and filter for the breath and air breathed through the nose which filter contains a disease germ killing or deactivating liquid chemical encapsulated within micro capsules or a material impregnating the cells of the mask, wherein the micro capsules are caused to slowly release their chemical contents by the heat and vapor of the breath of the person wearing the mask and breathing therethrough.

Another object is to provide a face mask made of a sheet-like filter material and a film of porous plastic resin containing a disease germ killing or deactivating chemical.

Another object is to provide a face mask made of a sheet-like filter material and having a strip of plastic film bonded to a portion of the mask which extends across the nostrils and mouth of the wearer, wherein filter material and/or a strip of plastic contain or retain one or more blisters or capsules contain a disease germ killing liquid which is released when the strip is pulled off the filter material to which it is sealed or bonded.

Another object is to provide a face mask with a disease germ destroying or deactivating agent encapsulated within or in the form of a solid material coating or contained within cells of the mask and releaseable from the solid to become active when water is applied by spraying or dipping the mask in a container of water.

Another object is to provide a face mask having a filter material extending across the mouth and nostrils of the wearer when the mask is properly worn, which filter material contains a disease germ killing or deactivating agent, such as a mild acid, or a biological agent such as an antibiotic, a portion of which may be inhaled by a person using the mask.

With the above and such other objects in view as may hereafter more fully appear, the invention consists of the novel constructions, combinations and arrangements of parts and elements and the methods employed to trap and kill disease germs, as will be more fully described and illustrated in the accompanying drawings, but it is to be understood that changes, variations and modifications may be resorted to which fall within the scope of the invention as claimed.

BRIEF DESCRIPTION OF THE DRAWINGS

The above and other objectives and advantages of this invention will be better understood with reference to the following detailed description of the invention read in conjunction with the accompanying figures in which:

FIG. 1 shows a face mask 10 having a body 11 formed of a suitable porous material, such as gauze, plastic impregnated gauze, open cell foamed plastic, nonwoven fibrous material, porous paper or the like material which is capable of being die, pressure or vacuum formed to a shape conforming to the nose and mouth portions of a person wearing such mask and the portion of the face immediately surrounding such nose and mouth portions.

Central portion 12 of the mask base 11 is directly aligned with and may extend a peripheral distance from the nostrils of the nose and the mouth of a person wearing the mask. Such central portion 12 as defined by the dashed profile is fully or at least partially impregnated or coated with a chemical and/or biological agent or agents capable of killing bacteria and/or viruses which may pass through the mask in either direction during breathing. Various acidic chemicals, such as citric acid, acetic acid or other chemicals may be employed, for example, as an impregnating or coating material disposed against or within the filaments or cell structure of central portion 12 for destroying a variety of different disease causing or carrying bacteria or viruses such as retrovirus, tubercular bacteria, etc.

A chemical 13 is impregnated within (FIG. 3) or forms part of a porous member (FIG. 4), such as porous tissue paper, gauze or plastic which is bonded or laminated to either the outside layer of the material forming base 11 of the mask or disposed within one or more layers of such material in alignment with central mask portion 12.

Figure 2:
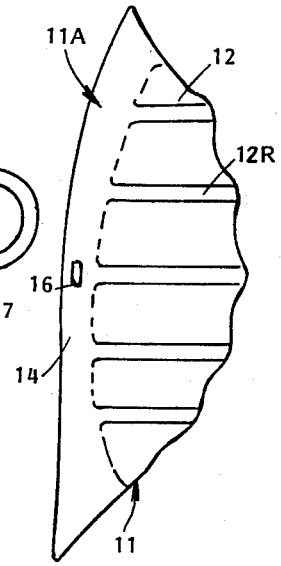
FIG. 2 is a fragmentary side elevational view of the mask of FIG. 1.

In FIG. 2, side mask portion 14 contains hole 16 cut or molded therein. An elastic string or rubber band 18 or a plurality of same may be secured to mask portion 14 through opening 16 and another opening 17 at the other end 15 of mask 10 against the face of the wearer.

Figure 1:
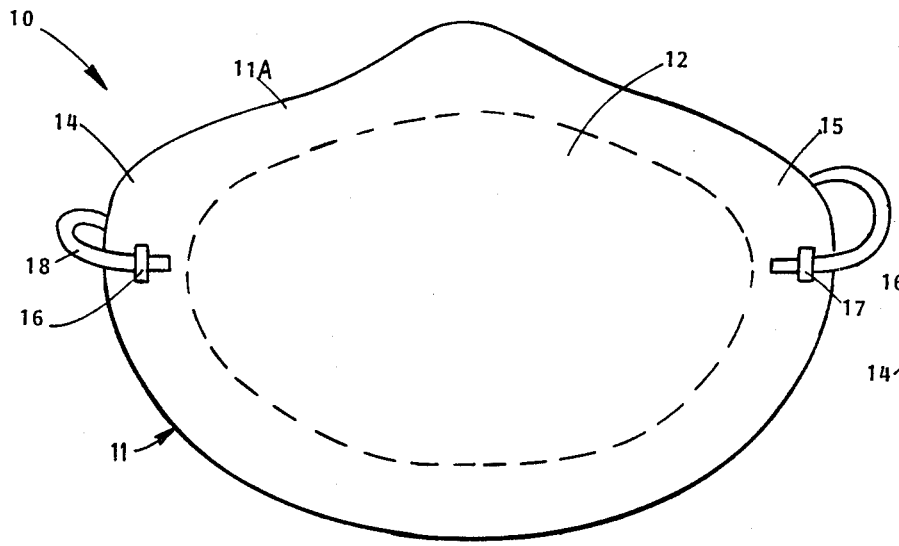
FIG. 1 is a front elevational view of a face mask for use in preventing the spread of disease.

Face mask holding body 11 may be formed of a woven textile or plastic material such as gauze or plastic impregnated gauze or laminates of two or more of such materials. The sheet-like body 11 of FIG. 1 is molded to a cup-like shape having a circumscribing rim 11A adapted to abut and conform to the face of the wearer when an elastic band or strap 18 is secured to the side end mask portions 14 and 15 by respective fasteners or staples 16 and 17 strap 18 tightly draws rim 11A around the mouth and nose of the wearer, so that all of the ambient air used in breathing through the mouth or nose of the person must pass through the pores of the mask.

Central portion 12 may contain a capping sheet of such an agent capable of killing bacteria and/or viruses which may pass through the mask in either direction during breathing. The various acidic chemicals, may be disposed within certain filaments or micro capsules which biodegrade or otherwise release such chemicals, such as when compressed, to permit the chemicals to receive and kill or deactivate disease germs passing through the mask, such as when contacted by the vapor of the chemicals. Citric acid, for example, is effective in killing a variety of disease bacteria or viruses, such as retrovirus, tubercular bacteria, etc. The band-like peripheral mask portion or rim 11A surrounding the chemical containing portion 12 thereof need not be impregnated or coated with the chemical or bacterial agent contained in portion 12. If the entire mask body 11 contains such a chemical, the inside surface of portion or rim 11A may be coated or laminated to an annular formation of non-porous plastic film which abuts the skin of the face of the wearer and prevents the chemical from contacting the same.

The central portion 12 shown in FIG. 2 includes a plurality of parallel rib-like formations 12R extending across mask body 11 for providing rigidity to retain its cup-like shape. An additional reinforcing element [not shown], such as a strip of plastic or metal, may extend across mask 10 and be welded or secured thereto, for example, by staples 16 and 17 which secure the ends of the strap or rubber band 18 as shown in FIG. 1.

Figure 3:
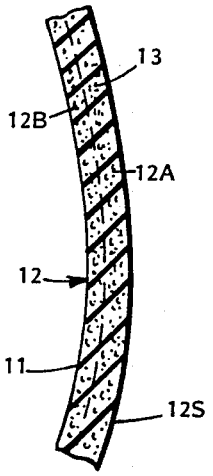
FIG. 3 is a fragmentary cross sectional view of one form of the mask of FIG. 1 showing a chemical agent impregnating the outer stratum of the mask.

The embodiment of FIG. 3 comprises a mask 10 with central portion 12 having an outer layer 12A, conforming to the nose and mouth portions of the mask as described. Outer layer 12A is impregnated with a chemical and/or bacterial agent 13 of the type described, the chemical agent does not impregnate or form part of the inner portion 12B which engages the skin of the face of the wearer. As a result, the face of the wearer is not in direct contact with the disease killing chemical 13 and is therefore not normally affected or irritated thereby. The chemical or bacterial agent 13 may be impregnated by spraying, dipping or screen printing as same in liquid form on the outer surface 12S of the mask base 12.

Figure 4:
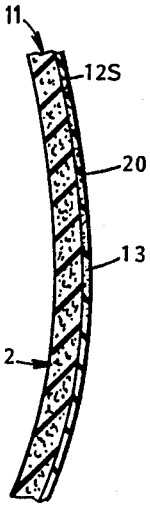
FIG. 4 is a fragmentary cross sectional view of another form of the mask illustrated in FIG. 1 showing a chemical agent coating a portion of the outer surface of the mask.

In the embodiment of FIG. 4, chemical 13 impregnates a sheet 20 of porous material, such as tissue paper, a laminate of tissue paper and ordinary gauze or a foamed plastic, a sheet or layer of porous plastic or a plurality of layers thereof, a non-woven fabric or a filter type type material formed of filaments which are compressed and bonded together, a thin sheet of open cell foamed plastic, or laminates thereof FIG. 4 shows such sheet material 20 laminated and bonded to the outer surface 12S. Sheet 20 is aligned with central portion 12 which surrounds the nose and mouth of the wearer. Such bonding may be effected by heat and pressure between dies which serve to heat form and seal the mask portions 20 and 12 together, or by an adhesive spotted between the two portions or by mechanical fastening means.

Figure 5:
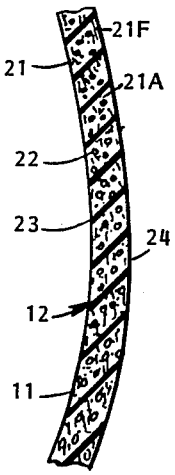
FIG. 5 is a fragmentary cross sectional view of the wall of another form of face mask having a disease germ killing chemical or biological agent disposed between outer and inner layers of material which forms the wall of the mask.

The third embodiment in FIG. 5 comprises a mask of the type described with a central portion 12 formed of a cellular or fibrous material 21 containing a multitude of fibers 21E which are bonded together. Central portion 12 also contains a multitude of micro capsules 22, each containing a quantity of a liquid chemical and/or biological agent of the type described for killing or rendering bacteria and/or viruses inactive. When pressure and/or heat is applied to mask 10, micro capsules 22 rupture or melt releasing their contents to the surrounding fiberous material. The micro capsules 22 are shown bonded to those filaments or cell walls of the porous base material 21 which make up the outer layer 21A of the mask base so that when the contents thereof are released by rupturing or melting the walls of the micro capsules, such chemical or bacterial agent will not normally make contact with the skin of the face of the person wearing the mask.

While the mask structure of FIG. 5 may comprise a single layer or sheet of porous or fiberous material having the micro balloons or micro capsules 22 retained within the sheet by the fibers or bonded to the fibers, it may also contain a layer or film of porous plastic secured to the inside surface 23 thereof or coated thereon and/or coated or laminated to outer surface 24. As described above, such porous plastic or film may coat the entire surface or surfaces of the mask or just central portion 12 of the mask. In other words, if micro capsules 22 and merely disposed within the central portion 12, then the protective film may be disposed only across central portion 12 to prevent the liquid released from capsules 22 from contacting the skin of the face and/or the hands. Otherwise the micro capsules 22 and film may extend throughout the entire mask configuration.

Figure 6:
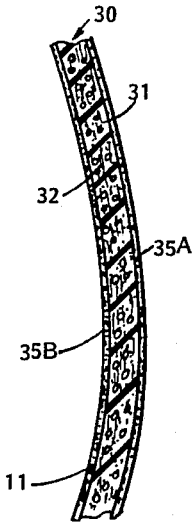
FIG. 6 is a fragmentary cross sectional view of the wall of a mask, the major portion of which is made of porous material impregnated with a disease germ killing agent, wherein the inside surface of the mask is coated with a porous film of plastic adapted to prevent the flow of the disease germ killing agent to the skin of the wearer of the mask.

The embodiment of FIG. 6 comprises a mask 30 with a central porous portion 31 impregnated with solid or liquid disease germ killing material coating the walls of the cells or fibers 32 which form central portion 12. Central portion 31 may also contain rupturable or otherwise releasable micro capsules 22 bonded to such cell walls or fibers with adhesive or simply held within the cells or interstices defined by the fibers. Laminated to or coated on the inside and outside surfaces of central portion 31 are respective sheets or layers 35B and 35A of porous plastic film which protect the skin of the face and hands from the disease germ killing agent when released via the environmental conditions as described herein.

Figure 7:
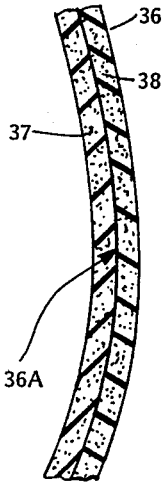
FIG. 7 is a fragmentary cross sectional view of the wall of a mask made of a lamination of two sheets or layers of porous or cellular material, between which layers is disposed a layer of disease germ killing chemical.

The embodiment of FIG. 7 comprises mask body 36 having two sheets 37 and 38 of cellular filter-type paper or plastic laminated together by heat sealing. Alternatively, adhesive may be disposed around the periphery of the mask adjacent the outer rim thereof and/or applied at a plurality of spot-like locations of the interface of the mask so as to not interfere with the general flow of air through the mask. Outer sheet 38 may be coated on its outer surface or totally impregnated with a bacteria, germ and virus killing chemical. Sheet 38 may contain micro capsules or micro balloons coated on the outer surface, disposed within its structure and bonded to its cells or fibers as with respect to the earlier embodiments.

Such chemicals may be described or disposed along the interface 36A between the inner and outer sheets 37 and 38. If so located at interface 36, micro capsules or otherwise formed chemical agents will be kept from contact with the skin of the hands and the face permitting mask body 36 to be pressed between the fingers to release the disease germ killing chemicals from the micro capsules when they rupture or otherwise activate such chemical or chemicals.

In a particular form, such disease germ killing chemicals may be a solid material which sublimes when exposed to the air or slightly heated by the heat of the breath or which vaporizes when activated by the vapor and/or heat of the breath passing through the mask. Thus, the chemical is in a state whereby it will effect a disease germ killing action in addition to killing those disease germs which pass through the mask and alight or deposit on the fibers or walls of the cells containing such chemical.

Various techniques are known in the art for encapsulating liquids in rupturable or volatizable micro balloons or micro capsules and for forming solid or porous materials containing medications and disease killing agents which may be released therefrom when heated and/or subjected to vapor, such as the vapor of the breath. Centrifugal casting of rupturable capsules from various synthetic and natural resins containing liquid materials has been developed by the Southwest Research Institute as well as other organization. Capsules varying from about 100 microns to to about 10,000 microns or more may be disposed within the cells or interstices of the porous or cellular filter material 21 of FIG. 5, central portion 31 of the mask 30 of FIG. 6, or at the interface 36A between the porous sheets 37 and 38 of the mask body 36 FIG. 7.

Particles of disease germ killing or deactivating material, varying from a micron or less in diameter to several microns or more, such as crystals of citric acid or a mixture of such material in a volatizable material such as a natural or synthetic wax or other material such as glyceryl monostearate, camphor, methyl salicylate and the like having a low boiling or subliming temperature at atmospheric pressure to permit them to vaporize at temperatures in the range of 90° to 100° in the range of body temperature or the temperature of the breath. Further, such disease germ killing material may be formed and incorporated within the cells of the filter mask material, coated thereon and impregnated for a select depth therein or disposed between layers thereof such as the layers defining the sandwich structure of FIG. 6 or the two-layer laminate of FIG. 7.

In yet another mask construction, droplets of such volatile material containing or defining the disease germ killing agent may be sprayed or electrostatically applied to space separated portions of the outer surface of the filter portion of the mask, the respective faces of a porous plastic capping sheet such as layers 35A or 35B of FIG. 6, or the interface 36A between two layers of filter material. As indicated above, the disease germ killing agent in a liquid, crystal or powder form may also be provided in a large blister-like container or containers made of heat sealed plastic film and bonded against the outer surface of the mask filter element, between layers thereof or between a porous capping sheet. Such film may also be formed as a removable capping sheet, or form part of such removable capping sheet which is bonded or removably sealed to the outside surface of the mask base or filter. When accessible on such outside surface, the film may be pricked with a pin, cut into with a blade, ruptured with finger pressure or torn open when the removable film is manually pulled off the mask just before it is worn.

While a volatile encapsulant or matrix material of the types described may be employed to slowly release the disease germ killing or deactivating agent, matrices such as open cell cellular plastic materials made of polyethylene, polypropylene, ethylene, vinyl acetate copolymer, and the like may be employed such materials slowly release their contents of disease germ killing liquid chemicals such as citric acid, through the cells or through one or more laser drilled holes in a membrane containing the same. The release of the contents takes place when the heat of the breath causes pressure to be applied thereto or by gravity. If the chemical contents are in a solid volatile form, the vapor thereof may be slowly released to the interstices or cells of the mask filter material to fill the same and kill or deactivate disease germs which have flowed therein while breathing therethrough.

In place of certain liquid or solid disease germ killing or deactivating chemicals, biological elements may be used in a liquid or solid volatizable medium encapsulated or disposed as described herein. Such biological elements include antibiotics, antibodies, phages and the like or combinations of the same. The biological elements may be provided to be controllably released and applied to the mask cell walls, cell volumes and interstices surfaces, per se or in combination with other disease germ killing agents as described, to effect the described disease control function when the mask is used.

To trigger or hasten the release of the disease germ destroying or deactivating agent from encapsulation or solid form, certain arrangements may employ water soluble encapsulants which are released so as to saturate central portions 12 or 51 of the mask when water is applied to the mask or the portion thereof containing the solid water soluble material.

In another form of the invention, the described chemical or biological agent may be replaced or supplemented with a solid sublimable chemical which volatizes or vaporizes when the mask is worn and the breath is passed therethrough. Upon vaporization such agent will be inhaled by the wearer as a medication for treating a malady such as a cold, viral infection or the like associated with the throat, sinuses and lungs which receive and pass the breath bearing the same. Such releasable medication may be in the form of an antibiotic, antiseptic, anti-bacterial or virus destroying medication or other agent such as a decongestant, anti-allergic or other agent or agents delivered from storage in the mask.

In another form, the mask filter material may contain a reaction material which changes color or becomes visible from an invisible form, when it receives one or more disease germ, which culture in the cells or interstices of the mask filter element and multiply to effect a chemical reaction which becomes visible for detection and diagnastic purposes. The mask may also contain means for culturing and/or collecting disease germ in the cells or interstices thereof which cultures are used in further tests after the mask is worn for awhile.

Micro capsules contained in microporous walls or wall portions and encapsulating respective quantities of disease germ killing or deactivating agents, as described, or in liquid or solid sublimable form and/or other medications such as antibiotics and anti-viral biological agents, decongestants or other drugs desired to be inhaled during breathing, may be applied as described above to the cells, interstices, interfaces or surfaces of the mask structures described and illustrated in the drawings for slowly releasing their contents as a liquid and/or vapor to the volumes defined by the mask cells and the air passing through the mask. Such micro capsules may be made and filled in accordance with the teachings of U.S. Pat. No. 3,977,992, which provides capsules having microscopic passages or interconnecting pores providing release routes for the contents of the capsules. The pores are preferably such that they will pass liquid or vapor to the filter portion of the mask in or against which the capsules are retained. Such passage will take place after the mask is used and subject to the vapor and temperature of the breath passing through the mask. Such passage may also be effected when the user applies a liquid, such as water. Liquid such as solvent or water may also be released when certain of the capsules are ruptured by finger pressure or when moisture of the breath expands or softens the material of the capsules or adjacent capsules.

Porous films, employed as described to cover select portions of the outer surface or surfaces of the mask filter material, or to cover crystals or otherwise formed particles of disease germ destroying or deactivating material coated on or impregnated in the mask cells, may be made in accordance with the teachings of U.S. Pat. No. 3,059,379 and other U.S. Patents.

In addition to the use of solid encapsulants which sublime and release their contents by flow or volatization, capsules made of crystalling polymers, such as polyolefins, containing such agents and medications as described may be made in accordance with the teachings of U.S. Pat. No. 3,423,389.

Homogeneous mixtures of crush resistant porous capsules containing a liquid disease germ destroying or deactivating agent and rupturable capsules containing a solvent or other liquid for causing the contents of the porous capsules to be released by osmotic action or by dissolving non-porous coatings on the porous capsules when the liquid is released from the crushed or ruptured capsules, may also be applied to the surfaces or cells of the mask filter materials described.

Figure 8:
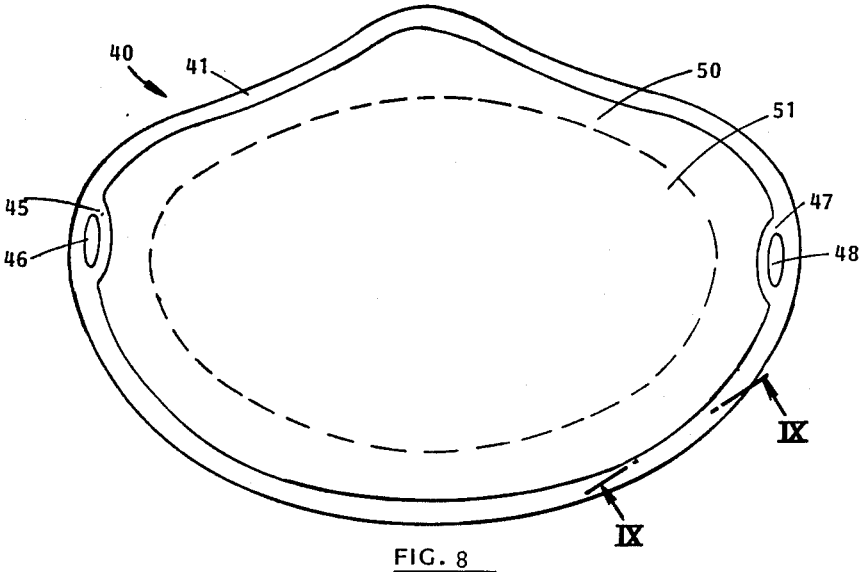
FIG. 8 is a front elevational view of another embodiment of a mask of the invention having a frame.
Figure 9:
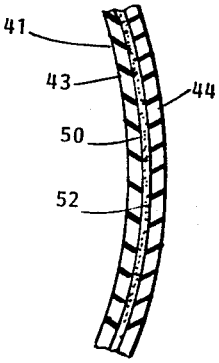
FIG. 9 is a fragmentary cross sectional view of the mask of FIG. 8 showing how the components thereof are assembled together.

The embodiment of FIGS. 8 and 9 comprises a mask assembly 40 formed of a frame 41 made of two circumscribing frame elements 43 and 44 with a porous, sheet-like central portion 50 extending across and supported by the frame. The rim or border of the porous material 50 may be made in any of the configurations described above and is held by friction, heatsealing or adhesive across frame 41 when frame elements 43 and 44 are assembled together as shown in FIG. 9.

Frame elements 43 and 44 may be formed by injection molding the same from plastic to configurations permitting them to properly fit together compressing the porous mask body 50 therebetween in a manner such that frictional assembly of elements 43 and 44 will retain mask body 50 with frame 41. Alternatively, when elements 43 and 44 are assembled, compressed and heat sealed or otherwise bonded together, such mask body 50 will have its rim portion 52 secured between frame elements 43 and 44.

Each respective border portion 45 and 47 of frame 41 is molded with respective holes or elongated openings 46 and 48 for receiving the ends of a strap or rubber band which may be tied or otherwise secured to mask frame 41 after passing through openings 46 and 48 to retain same in assembly therewith. Frame 41 may also be made of a single molding shaped to accommodate the rim portion 52 of the porous mask 50 which may be bonded thereto or may be formed of two annular elements which frictionally assemble together to support the mask 50 and permit it to be replaced with a new filter element when the frame elements 43 and 44 are pried apart for disassembly permitting the old mask 50 to be removed therefrom, replaced with a new mask when assembly is effected by pressing the two mask frame elements 43 and 44 together with the rim portion 52 of the mask base disposed therebetween.

In a modified form of mask 40, the external contour of frame 41 may be that shown, while the rim portion thereof which supports the filter material is circular as is the filter itself with the rim portion of the mask frame 41 being molded with a threaded neck for receiving a circular annular cap employed to releasably hold the disc shaped filter element in place.

Additional modifications to the mask constructions illustrated in the drawings and described above are noted as follows:

1. One or more larger capsules or blister-like containers which are larger than the described micro balloons 22 and 32 of FIGS. 5 and 6 may be incorporated within the filter material of the mask, disposed between layers thereof, such as at the interface 39 of the mask filter material or base sheet 36 of FIG. 7 or bonded to the outside surface of the central portion 12 or 51 of the mask and operable to release a liquid therefrom, such as citric acid or other disease killing materials when the capsule(s) is compressed between the fingers or pricked with a pin. The liquid flowing from such capsule(s) may be such that it permeates the central portion 12 of the mask and remains therein for an extended time interval, such as one or more hours to protect the wearer from disease germs or viruses or to kill such disease elements, if present in the breath or cough of the wearer.

2. The frame 41 of FIG. 8 may have a small reservoir of such a disease killing chemical which may be released therefrom by gravity when the mask is worn or by compressing the walls of the frame reservoir between the fingers to force such liquid out of the reservoir through one or more small holes therein.

I claim:

1. A face mask comprising:

(a) a unitary mask base formed of a sheet material and shaped to be disposed across a portion of the face of a wearer in alignment with and surrounding the nose and mouth of the wearer of said mask, (b) said mask base including a central portion adapted to be aligned with the nose and mouth of the wearer, (c) said mask base being formed of a laminate of a plurality of layers of porous materials, (d) a disease germ killing agent means disposed within said central portion and operable to destroy disease germs, such as bacteria and viruses, passing through said central portion, (e) said disease germ killing agent means being located between exterior and interior portions of said central portion for killing disease germs without normally contacting the skin of a person handling and/or wearing said mask.

2. A mask in accordance with claim 1, wherein said porous material layers are formed of substantially the same porous sheet materials.

3. A mask in accordance with claim 1, wherein said porous material layers are each formed of a non-woven material containing a multitude of filaments.

4. A face mask comprising in combination:

(a) a mask base shaped with a peripheral portion adapted to operatively conform to a portion of the face of a person peripheral of the nose and mouth of such person, (b) said mask base having a central portion adapted to be disposed in direct alignment with the nose and mouth of the person wearing said mask base with the peripheral portion thereof operatively conforming to the face of the person, (c) said mask base comprising a unitary formation of a sheet-like porous filter material, (d) said central portion of said mask base containing a medicinal agent means for killing disease causing organisms carried on particles passed through the filter material of said central portion of said mask base during breathing by the person wearing said mask, and (e) said medicinal agent means being normally disposed in the filter material of the central portions of said mask base, away from the peripheral portion of said mask which conforms to the face of the person to prevent said medicinal agent means from normally contacting the skin of the person.

5. A mask in accordance with claim 4, wherein said mask base is shaped to dispose said central portion thereof away from the nose and mouth of the person wearing said mask base.

6. A mask in accordance with claim 4, wherein said central portion of said mask base containing said medicinal agent means in the outer portion of said sheet-like porous filter material.

7. A mask in accordance with claim 6, including a protective means laminated to and covering the central portion containing said medicinal agent means so as to prevent said medicinal agent means from normally contacting the skin of a person handling said mask.

8. A mask in accordance with claim 4, wherein said medicinal agent means is in a solid particulate form within said central portion.

9. A mask in accordance with claim 4, wherein said medicinal agent means is volatizable solid material which will volatize when gas defined by the breath of the person wearing said mask passes through said porous central portion of said mask base.

10. A mask in accordance with claim 4, wherein said medicinal agent means is a liquid impregnating a portion of the porous filter material forming said central portion, and is selected from the group of mild acids including citric acid, boric acid and the like.

11. A mask in accordance with claim 4, wherein said medicinal agent means includes a liquid encapsulated by encapsulating means secured to said porous filter material.

12. A mask in accordance with claim 11, wherein said encapsulating means comprises a multitude of microminiature capsules containing said liquid, said microminiature capsules being secured to said porous filter material and being rupturable by hand to release their liquid contents when said filter material is compressed between the fingers so as to cause said liquid to impregnate and wet at least a section of the central portion for destroying disease causing organisms passing through said central portion when said mask is in use.

13. A mask in accordance with claim 11, wherein said encapsulating means is made of a material which is volatizable by the breath of the person passing through said porous central portion of said mask.

14. A mask in accordance with claim 11, wherein said encapsulating means is volatizable when subjected to the heat of the breath of the person wearing said mask.

15. A mask in accordance with claim 4, further including encapsulating means for said medicinal agent means which is operable to release said agent means in response to the breath of the person wearing said mask when said breath passes through the porous central portion and contacts said encapsulating means.

16. A mask in accordance with claim 4, wherein said medicinal agent means includes a liquid encapsulated by encapsulating means, said encapsulating means being a rupturable capsule operable to release the liquid contained therein when ruptured by hand to permit said liquid to flow through and permeate at least a section of said central portion of the porous filter material at the center of said mask base.

17. A medical face mask comprising in combination:

(a) a mask base formed of a porous sheet material and having a peripheral portion and a central portion adapted to define a closed volume with the face around the mouth and nose of a person, (b) said mask base being concavely shaped to generally conform to the faces of various human beings, (c) a flexible band secured to said perpheral portion of said mask base for operatively holding said mask against the face of the person when said flexible band is extended around the head of the person, (d) a disease germ killing means disposed within a section of the central portion of said mask base for killing disease germs without normally contacting the skin of the person wearing said mask when said mask is operatively held against the face of the person, and (e) said disease germ killing means being operable to permit it to destroy disease germs passed through said central portion on dust particles during breathing by the person operatively wearing said mask.

18. A medical face mask in accordance with claim 17, wherein said disease germ killing agent means is disposed as a layer cross-sectionally within said porous sheet material of said central portion with the remaining portions of porous sheet material disposed exterior of said germ killing agent means layer to prevent said disease germ killing agent means from contacting the skin of the person.

19. A medical face mask in accordance with claim 17, wherein said disease germ killing agent means is disposed as a coating on its exterior surface of said porous sheet material of the central portion and is prevented by the remaining portion of said sheet material from contacting the skin of the face of the person wearing said mask.

20. A medical face mask in accordanc with claim 17, wherein said disease germ killing agent means is disposed on said central portion of said mask base to the exclusion of the portion of said mask base peripheral of said central portion.

21. A medical face mask in accordance with claim 17, wherein said disease germ killing means is disposed only within the central portion of said mask.

22. A face mask comprising in combination:

(a) a mask base adapted to operatively conform to a portion of the face of a person about the nose and mouth, (b) said mask base comprising a sheet-like porous filter material, (c) a central portion of said mask base containing a medicinal agent means for killing disease causing organisms carried on particles passed through the filter material of said central portion of said mask base during breathing by the person wearing said mask without normally contacting the skin of the person wearing said mask.

23. A medical face mask in accordance with claim 22, wherein said mask sheet-like porous material is constructed of a plurality of layers of material.

24. A medical face mask in accordance with claim 23, wherein said medicinal agent means is located on one of said plurality of layers adapted to be remote from the skin of the person wearing said mask.

25. A medical face mask in accordance with claim 22, wherein said medicinal agent means is located only in the central portion of said mask.

* * * * *